United States Patent [19]

Flynn

[11] 4,411,433

[45] * Oct. 25, 1983

[54] BOARD GAME APPARATUS

[75] Inventor: William M. Flynn, Boise, Id.

[73] Assignee: The Gametree Company, Boise, Id.

[ * ] Notice: The portion of the term of this patent subsequent to Dec. 15, 1998, has been disclaimed.

[21] Appl. No.: 307,584

[22] Filed: Oct. 1, 1981

Related U.S. Application Data

[63] Continuation-in-part of Ser. No. 951,350, Oct. 16, 1978, Pat. No. 4,305,585.

[51] Int. Cl.[3] ..... A63F 3/02

[52] U.S. Cl. ..... 273/260

[58] Field of Search ..... 273/260, 261, 287, 288, 273/258

[56] References Cited

U.S. PATENT DOCUMENTS 4,305,585 12/1981 Flynn ..... 273/261

FOREIGN PATENT DOCUMENTS 112018 10/1925 Switzerland ..... 273/260

*Primary Examiner*—Richard C. Pinkham
*Assistant Examiner*—Scott L. Brown
*Attorney, Agent, or Firm*—Paul F. Horton

[57] ABSTRACT

Apparatus for playing a game including a rectangular game board having 40 hexagonally recessed playing spaces in contiguous and aligned relationship representing 5 files and 8 ranks. Two sets of playing pieces, each set having 9 hexagonal playing pieces adapted to fit in the recessed playing spaces are provided. Each playing piece of each set is marked so as to indicate particular sides of the piece which are invulnerable to attack from an aligned playing piece of the opposing set. In playing a game, a piece may move in any aligned direction any number of spaces but may not "jump" another playing piece. A playing piece may also be rotated in position, constituting a move. A piece having a vulnerable side exposed to an aligned opposing piece is captured and removed from the game and the capturing piece takes its position. The game is won by placing a specified piece in a checkmate position.

2 Claims, 2 Drawing Figures

BOARD GAME APPARATUS

CONTINUATION IN-PART

This application is a continuation-in-part of application Ser. No. 951,350, filed Oct. 16, 1978 and now U.S. Pat. No. 4,305,585.

BACKGROUND OF THE INVENTION

It has long been recognized in the art that games between opposing players which permit angular attack from a distance on a confined playing board is a challenge to the mind and memory while still being useful for relaxation and rest.

SUMMARY OF THE INVENTION

The apparatus of the present invention provides a playing board having recessed playing spaces and two sets of playing pieces, each piece being insertable into one of the recesses. The playing pieces each have indicia on the top surface thereof to indicate sides of the piece which are invulnerable from attack. Rotation of the playing piece, either in place or when moved, greatly complicates offensive and defensive play. A more thorough description of the invention may be found in the claims.

It is therefore a general object of the present invention to provide board game apparatus which is thought provoking, challenging, and yet inexpensive.

Other objects and advantages will become apparent and a more thorough and comprehensive understanding may be had from the following description taken in conjunction with the accompanying drawings forming a part of this specification.

DETAILED DESCRIPTION OF THE INVENTION

Figure 1:
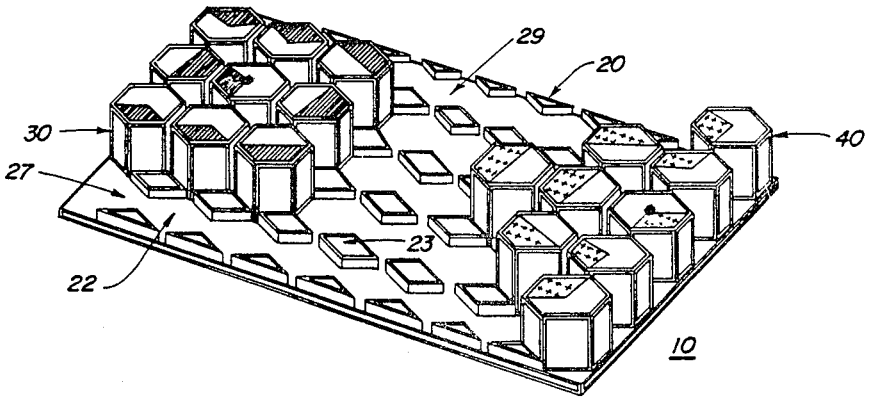
FIG. 1 is a perspective view of apparatus according to the present invention showing the playing pieces in two possible playing positions at the commencement of play.

Referring now to the drawings, in FIG. 1, an embodiment to be preferred of board game apparatus 10, made according to the present invention is disclosed. Apparatus 10 includes game board 20 and two opposing sets of playing pieces designated generally by the numerals 30 and 40.

Game board 20 is provided with a plurality of contiguous and aligned playing spaces 22. The playing spaces each define an enclosed figure having five or more rectilinear sides of equal length. In the preferred embodiment, the playing spaces have hexagonal configuration and define five vertical columns, termed files 27, and eight horizontal columns, termed ranks 29. While a total of forty playing spaces is preferred, it is to be understood that varying adaptations of the board may include more or less playing spaces. Playing spaces 22 may be recessed into the board leaving diamond shaped projections 23 for contacting the sides of the playing pieces to prevent accidental rotation or movement of the playing pieces off the playing space.

Apparatus 10 also preferably includes two sets of playing pieces having the same configuration as the playing spaces. In the embodiment shown in the figures, there are two sets 30 and 40 which may carry indicia, as for example differing colors, to distinguish between playing pieces of the two sets. The hexagonal cubes making up the playing pieces of each set each have two or three triangular markings on the top surface thereof encompassing two or three sides of the playing piece. Each set, containing nine pieces, is identical except as to the indicia separating the sets. Set 30 includes one playing piece 34, known as an Omnigon, having indicia 39 identifying it as an Omnigon and having two triangles encompassing two of the six sides to indicate those particular sides to be invulnerable from attack. Set 30 also includes four pieces 31, known as Tritrogs, having three sides invulnerable and four other pieces 32, known as Bitrogs, which, like the Omnigon, have two sides invulnerable from attack. All other sides are vulnerable to attack from an aligned opposing piece, as will hereinafter be explained. Set 40 has a corresponding number of playing pieces with corresponding indicia designated respectively by the numerals 44, 41 and 42. Indicia 49 identifies the Omnigon of set 40. The board and pieces may be made of any suitable material.

Rules of the game:

The game, called "Omnigon", is played between two players on a board having forty hexagonal spaces arranged in five files and eight ranks. Each player begins play with nine playing pieces, called Trogs, each playing piece having two or three triangularly marked areas indicating two or three sides which are invulnerable from attack from an aligned opposing Trog.

Playing pieces having two invulnerable sides and carrying special indicia are called Omnigons; two invulnerable sides Bitrogs; and three invulnerable sides Tritrogs.

In playing the game, the board is set up with the pieces of opposing sets in the position as shown in FIG. 1, or, in the alternative, either set may be placed in the formation shown by either set 30 or 40 in the figure.

The object of the game is to capture the opponent's Omnigon by placing it in a "checkmate" position, ie., in a position from which it cannot move without capture. Alternatively, the game can be won by capturing any six of the nine opposing playing pieces.

Opposing players decide by whatever means they choose as to who will play first.

Figure 2:
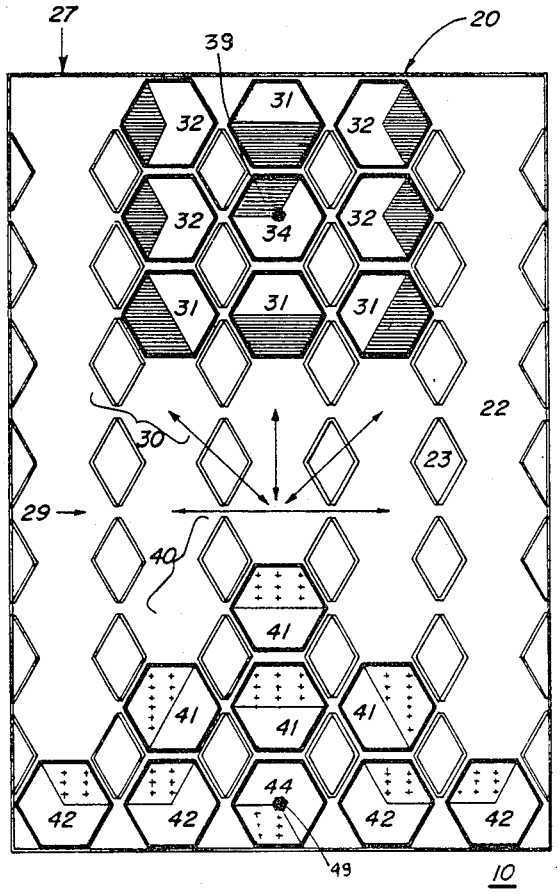
FIG. 2 is a plan view of the game board and playing pieces of FIG. 1.

To capture an opponent's Trogs, a player may do so by using any side of his own Trog, but can only capture an opponent's Trog by moving in a straight and unobstructed direction into an unprotected side of the opposing piece. At no time during the game can any Trog jump any other Trog, either his own or his opponents. Each Trog has the same ability for movement as every other Trog. Each Trog has a potential to move in eight different directions on the game board as indicated by the arrows in FIG. 2. A playing piece may be moved forwardly or backwardly along rank and file and along oblique rows. A player is allowed one move a play and the Trog may be moved in any one direction any desired distance and may be rotated in doing so to place a protected side in a selected position. A player may also rotate a Trog without forward or reverse motion, which will constitute one move. A player may rotate a Trog in the same playing space a maximum of two times. If caught doing so a third time, the Trog will be taken by default and the player will lose his turn.

To prevent capture in the horizontal plane, ie., along rank, both sides of the Trog facing the opponent on the same plane must contain protective indicia.

A player may not put his own Omnigon into jeopardy. The move must be called back and another move made.

Players are allowed to test move, but once the hand is taken from a repositioned Trog the move is final.

A variation of the Omnigon game may be played wherein the object is to move as many Trogs as possible into the back two ranks of the opposition's side of the board.

Having thus described in detail a preferred embodiment of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Apparatus for playing a game comprising:

a game board formed with a plurality of contiguous and aligned playing spaces; said board being rectangular in shape and having a grid defining five files and eight ranks of hexagonal playing spaces; and two sets of playing pieces simultaneously placeable on said game board in an adversary relationship; each playing piece of each set adapted to be placed in and selectively rotated within selected playing spaces; each of said sets having nine hexagonal playing pieces; each piece of each set having indicia identifying membership to that set; and each set having five playing pieces having indicia indicating two sides invulnerable from attack and four pieces having indicia indicating three sides invulnerable from attack.

2. Apparatus for playing a game comprising:

a game board rectangular in shape and having a grid defining five files and eight ranks of recessed hexagonal playing spaces; and two sets of opposing playing pieces, each set having nine hexagonal playing pieces having indicia identifying membership to a particular set, said pieces adapted to be inserted into said recessed spaces and each set having five playing pieces having indicia indicating two sides invulnerable from attack and four pieces having indicia indicating three sides invulnerable from attack.

* * * * *